United States Patent [19]

Seragnoli

[11] 4,154,438

[45] May 15, 1979

[54] HIGH SPEED CONVEYOR FOR FEEDING PRESHAPED PIECES OF CARDBOARD

[75] Inventor: Enzo Seragnoli, Bologna, Italy

[73] Assignee: G.D. Società per Azioni, Bologna, Italy

[21] Appl. No.: 791,190

[22] Filed: Apr. 27, 1977

[30] Foreign Application Priority Data

May 6, 1976 [IT] Italy ..... 3422 A/76

[51] Int. Cl.[2] ..... B65H 3/66; B65H 3/08

[52] U.S. Cl. ..... 271/12; 271/102; 271/108; 271/266; 271/275

[58] Field of Search ..... 271/12, 13, 11, 102, 271/99, 266, 271, 275, 108; 214/8.5 D

[56] References Cited

U.S. PATENT DOCUMENTS

| | | | |
|---|---|---|---|
| 2,727,740 | 12/1955 | Johnson | 271/102 X |
| 3,887,177 | 6/1975 | Farfaglia et al. | 271/12 |

*Primary Examiner*—Bruce H. Stoner, Jr.
*Attorney, Agent, or Firm*—H. Dale Palmatier

[57] ABSTRACT

A conveyor, particularly for feeding preshaped pieces of cardboard to a machine for packaging cigarettes into hinged lid packets, and in which a guide is provided to control the vertical position of said pieces when they fall from the bottom of an upper vessel on to said conveyor under the action of an extractor, said guide being movable to and from a working position in which the guide interferes with the falling path of said pieces.

4 Claims, 6 Drawing Figures

HIGH SPEED CONVEYOR FOR FEEDING PRESHAPED PIECES OF CARDBOARD

BACKGROUND OF THE INVENTION

This invention relates to a conveyor for feeding portions of sheet material to a user machine.

In particular, the present invention relates to an inlet or loading station for a continuous belt conveyor for feeding preshaped or punched pieces of cardboard or the like to a machine for packaging cigarettes into hinged lid packets from an accumulation and feed apparatus for said preshaped or punched pieces.

Italian patent No. 992.092 corresponding to U.S. Pat. No. 3,953,021 of the same applicant relates to an accumulation and feed apparatus of the aforesaid type in which the preshaped pieces to be fed to said packaging machines are continuously fed into a column vessel or magazine down which they descend by gravity, and from the lower end of which they are individually withdrawn by pneumatic extractor means and deposited on an inlet conveyor of a packaging machine.

Italian patent application No. 3421-A/76, filed May 6, 1976, corresponding to copending U.S. Application Ser. No. 791,327, filed Apr. 27, 1977 of the same applicant describes a conveyor comprising a flat support and slide surface for said preshaped pieces, along which these latter are fed stepwise by transverse mobile elements forming conveying compartments which exactly define the longitudinal position of the preshaped pieces along the conveyor.

The position of the preshaped pieces in a direction transverse to their feed direction is defined by shoulders carried by said flat support and slide surface and arranged to cooperate with the transverse opposing ends of the preshaped pieces. Finally, each preshaped piece is kept inside the relative conveying compartment by a vertical guide comprising at least one vertical knife disposed above said support and slide surface and defining therewith a slot in which the preshaped pieces slide. The use of such a vertical guide is made necessary by the very high frequency (up to seven steps per second or more) with which said conveyor is made to advance, and which otherwise would result in the immediate escape of the preshaped pieces from their conveying compartments.

The need to use a vertical guide requires the solution to a technical problem relative to loading the preshaped pieces on to the conveyor. This loading is in fact done from above at a conveyor inlet station by pneumatic extractor means, in particular suckers, which move with reciprocating motion to and from said support and slide surface in order to withdraw the preshaped pieces one by one from the bottom of said column vessel and deposit them on said support and slide surface below said vessel.

The presence of a vertical guide at said inlet station would hinder the aforesaid top loading, whereas on the other hand the absence of a vertical guide for the preshaped pieces at said inlet station would be inadmissible as it is precisely at this station that the vertical instability of the preshaped pieces is greatest.

SUMMARY OF THE INVENTION

The present invention brilliantly solves the aforesaid technical problem by providing a conveyor comprising an inlet station and an outlet station for said preshaped pieces, a support and slide surface for said preshaped pieces extending between said inlet station and said outlet station, a plurality of transverse elements defining a plurality of conveying compartments for said preshaped pieces, means for feeding said conveying compartments stepwise towards said outlet station, horizontally extending guide means disposed downstream of said inlet station to control the vertical position of the preshaped pieces inside the relative compartments along at least part of their feed path, and extractor means associable with a vessel or magazine for preshaped pieces extending upwards above said inlet station to extract said preshaped pieces one at a time from a bottom aperture in said vessel and deposit them on said support and slide surface each into a respective conveying compartment disposed at said inlet station, the conveyor also comprising at least one vertical guide element for said preshaped pieces, disposed at said inlet station and swinging to and from a working position in which it interferes with the falling path of said preshaped pieces from said vessel under the action of said extractor means, and operating means connected in parallel to said stepwise feed means and arranged to move said swinging guide element away from said working position as said extractor means descend towards said inlet station, and to return it there on termination of the descent.

BRIEF DESCRIPTION OF THE DRAWINGS

Further characteristics and advantages of the present invention will be evident from the description given hereinafter with reference to the accompanying drawings which illustrate a non-limiting embodiment and in which.

DETAILED DESCRIPTION OF THE INVENTION

Figure 1:
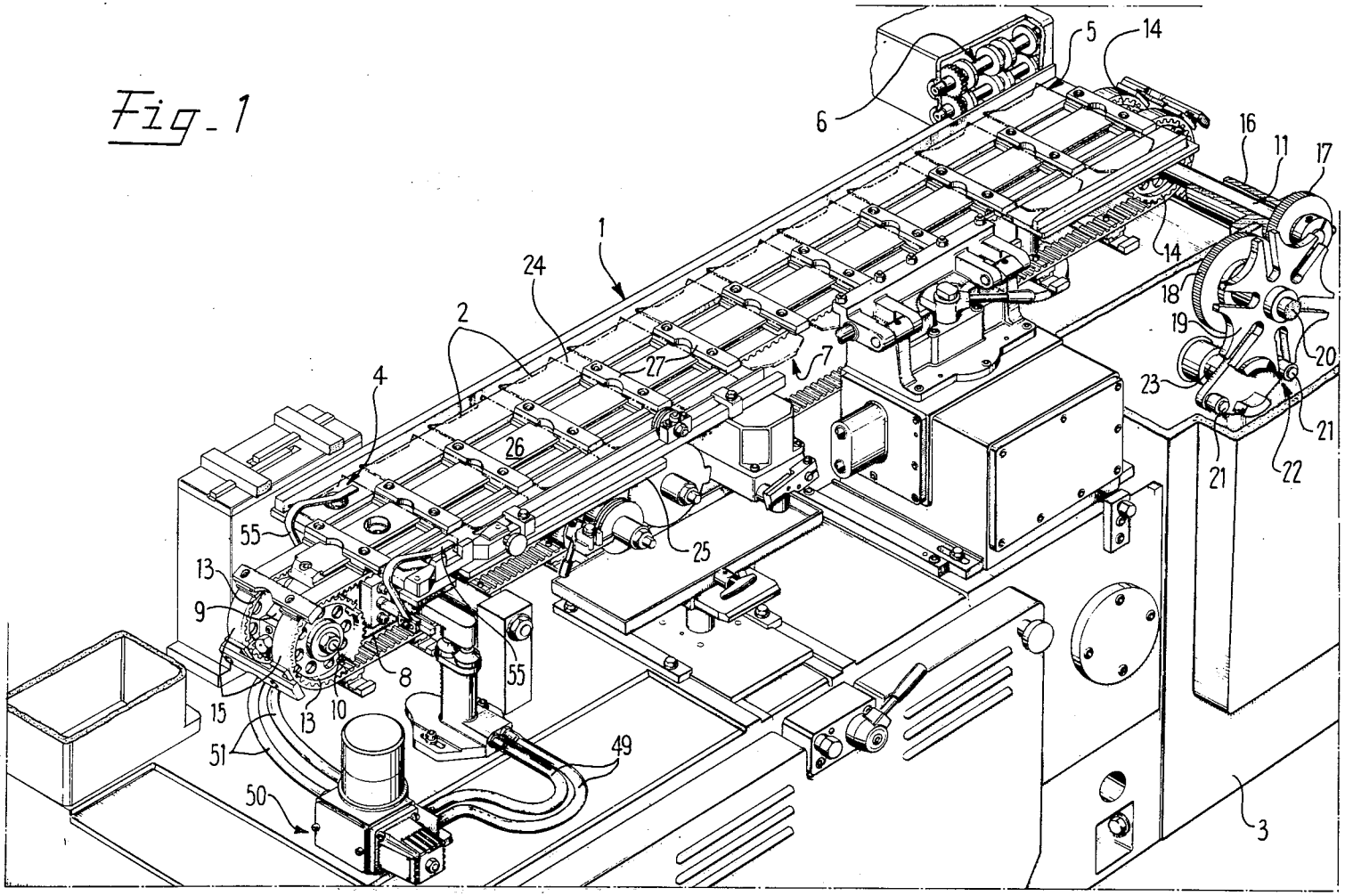
FIG. 1 is a three-quarter perspective view from above of a conveyor constructed in accordance with the present invention.

FIG. 1 shows a conveyor for use in feeding preshaped packaging pieces 2 to an intermittent machine for packaging cigarettes into hinged lid packets. The conveyor 1 is of the type described and claimed in said Italian patent application No. 3421-A/76 and U.S. Patent Application Ser. No. 791,327 applicant, and extends in a substantially horizontal direction above a base 3, between an inlet station 4 and an outlet station 5. At the station 5, for a detailed description of which reference should be made to Italian patent application No. 3423-A/76 filed May 6, 1976, corresponding to copending U.S. application Ser. No. 791,281, filed Apr. 27, 1977 of the same applicant, the preshaped pieces 2 are transferred on to a second conveyor 6 connected to said intermittent packaging machine (not shown). A folding station 7, for a detailed description of which reference should be made to Italian patent application No. 3424-A/76, filed May 6, 1976, corresponding to copending U.S. application Ser. No. 791,281, filed Apr. 27, 1977 of the same applicant, is disposed at a point along the conveyor 1 for folding a flap constituting one of the ends of the preshaped pieces 2.

Figure 2:
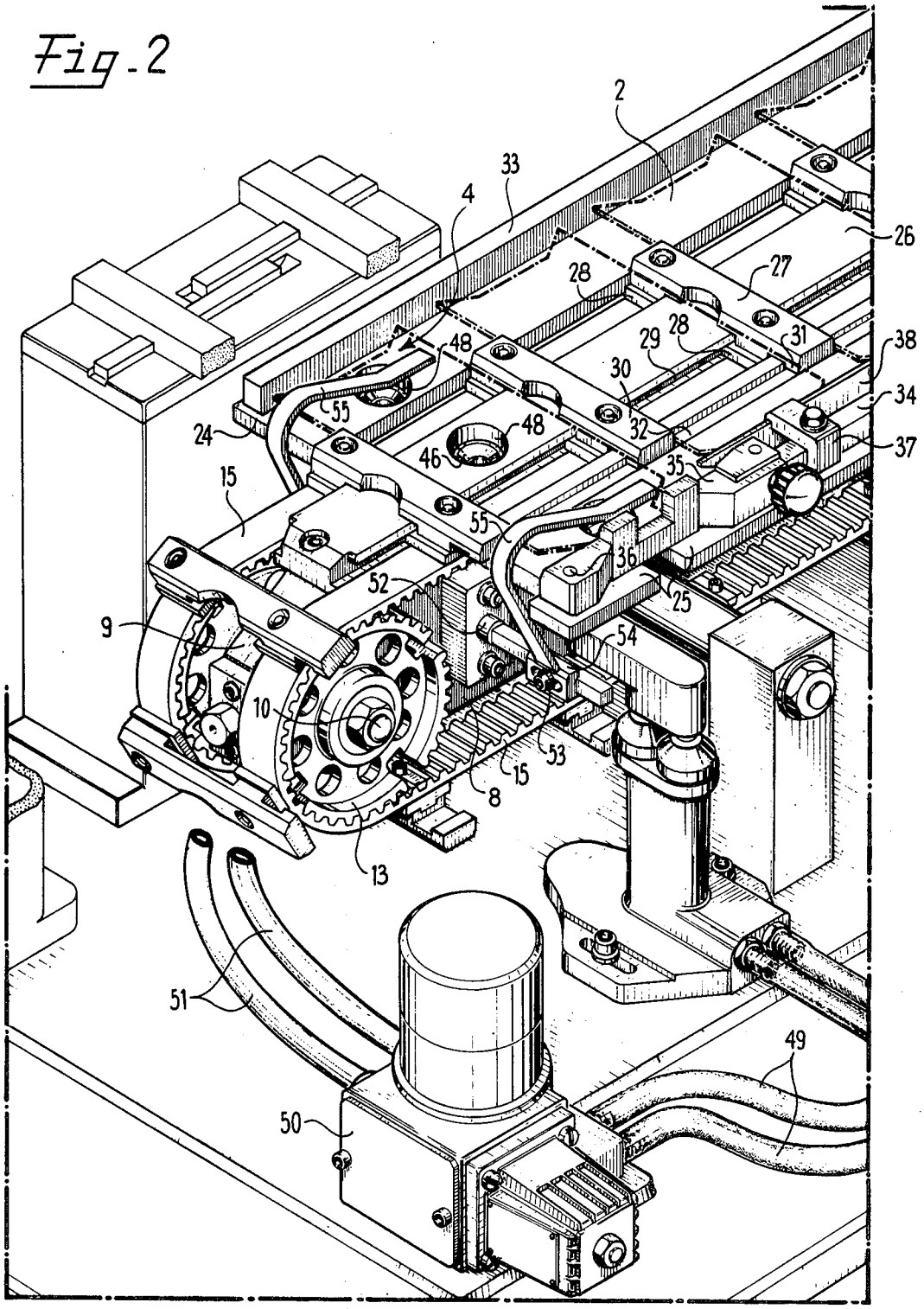
FIG. 2 is a perspective enlarged view of a detail of FIG. 1.

The conveyor 1 comprises a longitudinal frame or support and guide member 8 disposed in a substantially horizontal position above the base 3 and comprising, connected to its two ends, two blocks 9 (only one of which is shown in FIGS. 1 and 2) supporting two shafts 10 and 11 disposed horizontally and transversely to the axis of the longitudinal member 8.

On the two ends of the shaft 10 there are rotatably mounted two gear wheels 13, each of which supports and engages, together with a corresponding gear wheel 14 keyed on the shaft 11, a respective endless toothed belt 15 extending parallel to the axis of the longitudinal member 8.

One end of the shaft 11 extends rotatably through a sleeve 16 rigid with the base 3, and carries keyed thereon a gear wheel 17 which engages with a gear wheel 18 rigid and coaxial with a Maltese cross 19 rotatably mounted on a shaft 20 carried by the base 3.

The Maltese cross 19 is engaged by idle rollers 21 carried by a device of known type 22 rigid with a drive shaft 23 producing stepwise or intermittent driving of the shaft 11, the relative gear wheels 14 and the belts 15. Two stationary flat plates 24 and 25 are connected laterally to the longitudinal member 8 to extend along the member 8 and project laterally therefrom in opposing transverse directions, and a stationary longitudinal beam 26 is connected to the centre of the longitudinal member 8, this latter beam having a flat upper surface coplanar with the upper flat surfaces of the plates 24 and 25 to constitute, with these latter two surfaces, a support surface for the preshaped pieces 2. Each of these latter is disposed in a respective conveying compartment defined by two tie bars 27 extending transversely across and above the beam 26 and connected at their ends to the belts 15 via guide shoes 28. Each shoe 28 has a flat side surface in contact with a flat side surface of the beam 26, and a substantially rectangular lateral appendix or projection slidably engaged in a respective longitudinal lateral groove 29 in the beam 26.

The transverse position of the belts 15 and relative tie bars 27 is controlled both by the shoes 28 and by a lateral appendix or extension 30 extending from each tie bar 27 above the plate 25, and having an end tooth 31 extending downwardly into a longitudinal groove 32 provided on the upper surface of the plate 25.

The transverse position of the preshaped pieces 2 in their relative conveying compartments is controlled on one side by a guide rib or shoulder 33 connected to the upper surface of the plate 24, and on the other side by a guide rib or shoulder 34 connected to the upper surface of the plate 25.

Whereas the guide shoulder 33 extends longitudinally along the entire plate 24, the guide shoulder 34 is at least partly interrupted, at both the inlet station 4 and the folding station 7.

At the station 4, the shoulder 34 is replaced by a control gate 35 mounted rotatably on a pin 36 carried by the plate 25.

In order to prevent the preshaped pieces 2 from detaching themselves vertically from the plates 24 and 25 and from the beam 26, brackets 37 are connected to the shoulder 34 to project above the plate 25 and support a vertical elongate guide knife 38 which extends horizontally along conveyor 1 and which is also interrupted at the stations 4 and 7.

Figure 4:
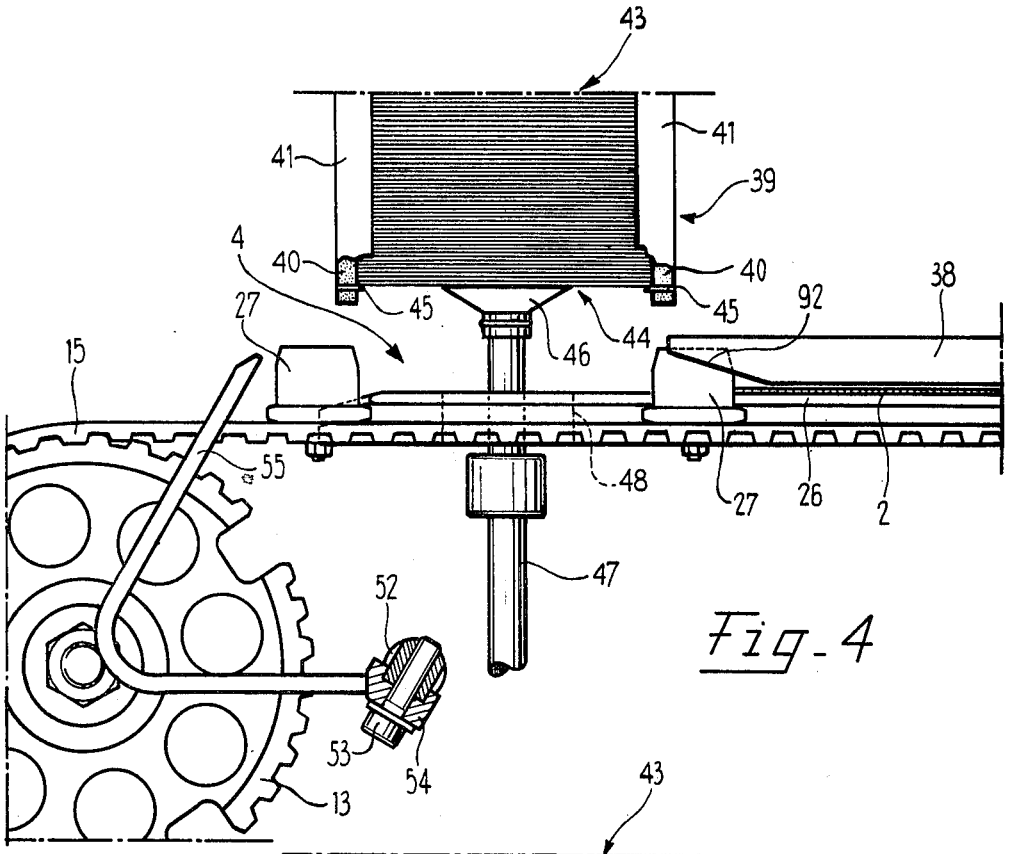
FIGS. 4 and 5 are diagrammatic illustrations of the conveyor of FIG. 1 in two different operation stages.
Figure 5:
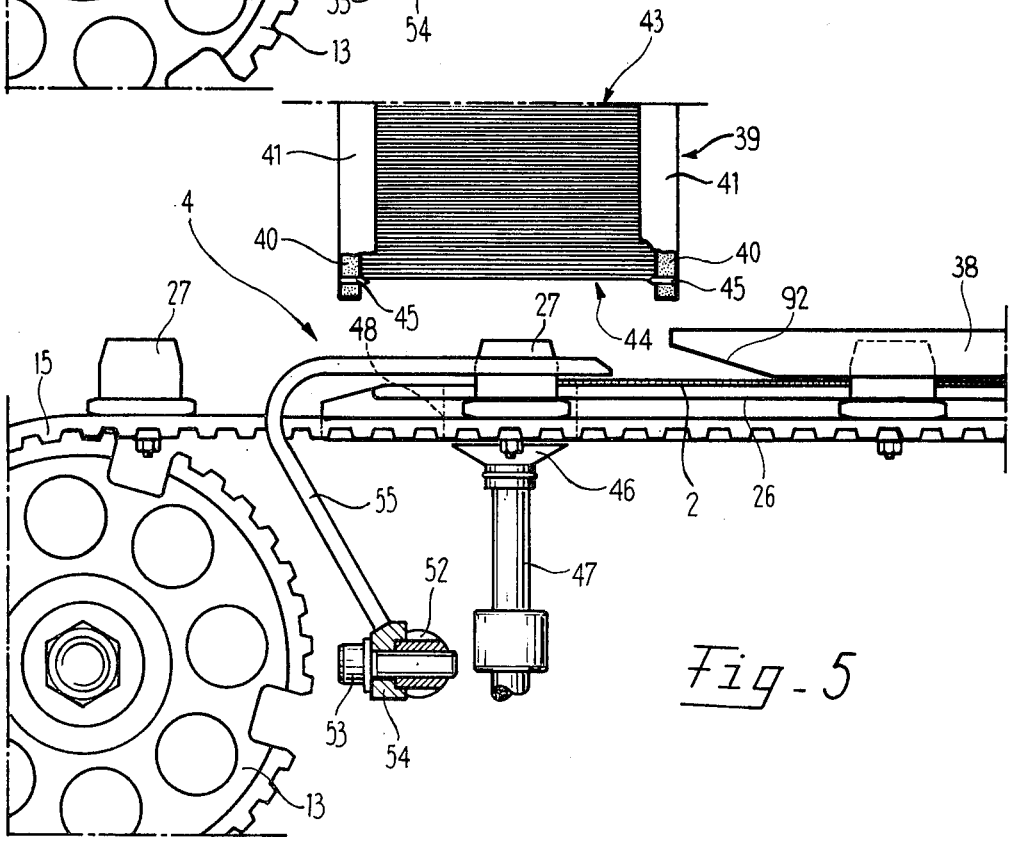

As shown in FIGS. 4 and 5, the inlet station 4 is disposed below the lower end of a column vessel or magazine indicated overall by 39, for a description of which reference should be made to Italian patent No. 992.092 of the same applicant.

The vessel 39 comprises two vertical lateral plates 40, to which vertical angle sections 41 are connected to define, together with the plates 40, a downward slide path for a stack 43 of shaped pieces 2.

The vessel 39 has a lower aperture or open bottom 44 bounded laterally by horizontal appendices or projection 45 to prevent the stack 43 falling downwards. The shaped pieces 2 are extracted from the bottom of the vessel 39 through the aperture 44 by suckers 46 supported at the upper end of respective vertical suction ducts 47 movable with reciprocating motion through respective holes 48 provided through the plates 24 and 25 and beam 26, and are connected via ducts or hoses 49 to a distributor 50 connected in its turn via ducts 51 to a pneumatic unit or source of vacuum pressure, not shown. The longitudinal frame member 8 rotatably supports, below the inlet station 4, a horizontal rocker transverse shaft 52 on which two support blocks 54 for two substantially U-shaped arms 55 are keyed in an axial position adjustable by respective locking screws 53.

Said arms are movable with the shaft 52 to swing between a first working position (FIG. 5) in which one of their end portions extends above the inlet station 4 at a short distance from the upper surface of the plates 24 and 25, and a second rest position (FIG. 4) in which said end portion is raised from the inlet station 4 and disposed outside the falling path followed by the shaped pieces 2 under the action of the suckers 46.

Figure 3:
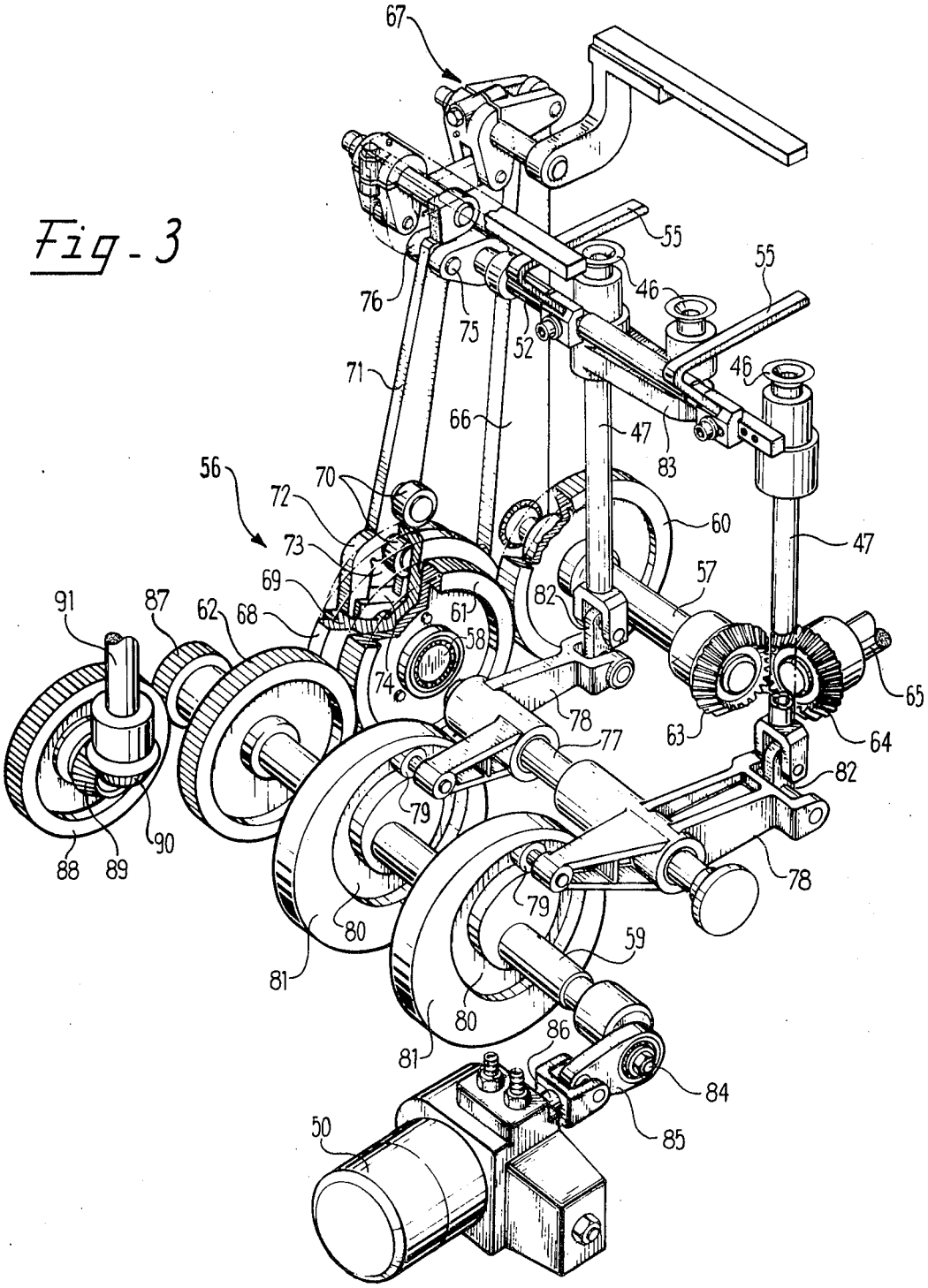
FIG. 3 is a perspective diagrammatic view of an operating and control unit for some mobile elements of FIGS. 1 and 2.

The movement of the suckers 46 and arms 55, and the operation of the distributor 50 are controlled by an operating and synchronising unit indicated overall by 56 and shown in FIG. 3.

The unit 56 is housed inside the base 3 immediately beneath inlet station 4 and comprises a rotatable shaft 57, a fixed shaft 58 and a rotatable shaft 59 all parallel to the shaft 52, and on which three identical cylindrical gear wheels 60, 61 and 62 are respectively mounted, the wheel 61 being idle on its shaft 58 and engaging both with the wheel 60 and the wheel 62.

The shaft 57 carries keyed thereon a bevel pinion 63 which engages with a bevel pinion 64 keyed on a shaft 65 extending along the base 3 and driven by a source of rotary power or drive unit (not shown) in coordinated relation with the shaft 23. As pointed out hereinafter, shaft 65 makes one complete revolution for each stepwise movement of the conveyor 1.

The small end of a connecting rod 66 is also mounted on the shaft 57 for operating a device 67 for skimming the preshaped pieces 2 forming the stack 43, and for a detailed description of which reference should be made to Italian patent application No, 3529A/73 corresponding to U.S. Pat. No. 3,947,017 of the same applicant.

Coaxially and rigid with the gear wheel 61 there is provided a disc cam 68, comprising an annular projection 69 engaged between two rollers 70 with their axes parallel to the axis of the shaft 58 and supported rotatably by a connecting rod 71 extending upwards perpendicular to the shaft 58.

The lower end of the connecting rod 71 is constituted by a fork 72 defining a rectangular axial recess 73 engaged slidably by a shoe 74 rigid with the fixed shaft 58.

The upper end of the connecting rod 71 is connected by a hinge or pin 75 with its axis parallel to the shaft 58, to a lever 76 keyed on the shaft 52.

Two rocker arms 78 have cam following rollers 79 mounted thereon, and are mounted on a shaft 77 parallel to the shafts 57, 58, 59.

Each roller 79 is engaged in a recess 80 in a respective disc cam 81 keyed on the shaft 59.

The other end of each rocker arm 78 is connected to the lower end of a respective connecting rod which is hinged to the lower end of one of the suction ducts 47.

In particular, as shown in FIG. 3, the two lateral ducts 47 and suckers 46 are supported by the respective connecting rods 82, while the central duct and its sucker 46 is connected via a connector 83 to one of the other two ducts 47. From one end of the shaft 59 there extends axially an eccentric pin 84 connected via a bearing to the small end of a connecting rod 85. This latter is arranged to swing in a vertical plane to impart an axial reciprocating movement to a control rod 86 for a slide valve (not shown) of the distributor 50.

On the second end of the shaft 59 (see FIG. 3) is keyed a gear wheel 87 for transmitting motion, via the gear wheel 88 and bevel gear pair 89, 90, to the vertical shaft 91 by which the preshaped piece feed device is moved (see said Italian patent No. 992,092, U.S. Pat. No. 3,953,021).

Figure 6:
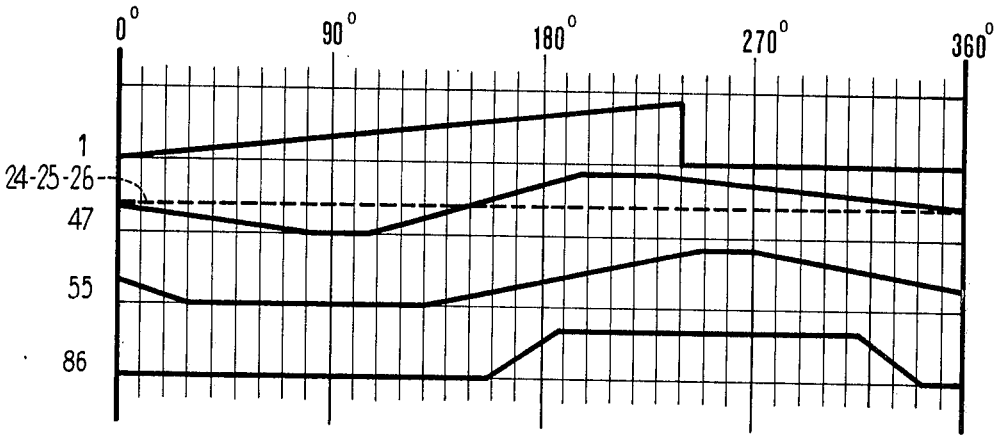
FIG. 6 shows time-phase diagrams for said mobile elements over one operating cycle of said elements.

The loading of a preshaped piece 2 on to the conveyor 1 is now described with reference to the operational diagrams of FIG. 6. These diagrams relate to one operating cycle of the conveyor 1, and approximately seven cycles occur each second. When the idle roller 21 engages with the Maltese cross 19 to cause it to rotate clockwise, the belts 15 begin a feed step to move a full feed compartment from the inlet station 4 and replace it by an empty compartment.

As shown, a single step movement of the conveyor 1 corresponds to a rotation of 360° of the shaft 65, and correspondingly of the shafts 57 and 59.

When the belts 15 commence their feed step, the ducts 47 are moving downwards under the action of the respective rocker arms 78 operated by the cams 81, while the mobile arms 55 are moving forwards towards the inlet station 4. In particular, the belts 15 begin to move when the shaft 59 is in an angular position such that the suckers 46 are in line with the upper surface of the plates 24 and 25 and beam 26, and their connection to said pneumatic unit (not shown) via the ducts 47 and 49, the distributor 50 and ducts 51 is interrupted at the distributor 50 by the rod 86 operated by the eccentric pin 84 carried by the shaft 59 to momentarily remove the vacuum from suckers 46 . Consequently, the preshaped piece 2 previously supported by the suckers 46 and connected to them is released and becomes placed on the plates 24 and 25 and beam 26 in a conveying compartment, and may be fed by the operation of the belts 15.

This feeding of said preshaped piece 2 is controlled by the mobile arms 55 which, under the thrust of the connecting rod 71 operated by the cam 68, are swinging into the working position shown in FIG. 5 and control the vertical position of or holddown the preshaped piece 2. Arms 55 hold down the piece 2 in the conveying compartment against the tendency of the piece 2 to roll backwards and upwards under the thrust of the rapidly moving rear tie bar 27 of the conveying compartment, and arms 55 also have the effect of guiding its front edge of preshaped piece 2 beneath the inclined surface 92 (FIGS. 4 and 5) provided on the end of the guide knife 38. Surface 92 will guide the preshaped piece beneath guide knife 38.

During a first part of the forward movement of the belts 15, the suckers 46, still disconnected from said pneumatic unit, continue to descend until they are in the position shown in FIG. 5, while the mobile arms 55 remain at rest in their working position above the station 4 so as to ensure that the preshaped piece 2 enters correctly under the knife 38.

The suckers 46 then begin to rise through the holes 48 and pass the level of the support surface for the preshaped pieces 2 as soon as the rear tie bar 27 of the conveying compartment, just filled, passes the holes 48.

Almost simultaneously, the rod 86 opens the distributor 50 so that suction or vaccum pressure is again applied through the ducts 47, and the cam 68 acts on the connecting rod 71 to withdraw the arms 55 from the station 4 and move them towards the second rest position shown in FIG. 4. This position is reached after the suckers 46, during the sucking stage, have been brought into contact with the base of the stack 43 and have already begun their descent stage, and after the belts 15 have again stopped.

The lowermost preshaped piece in the stack 43 curves centrally downwards under the action of the descending sucker 46, and as it passes the appendices 45 leaves the vessel 39 through the aperture 44 and moves downwards supported by the suckers 46 until it rests on the plates 24 and 25 and beam 26 in the relative feed compartment.

During the downward movement of the suckers 46, the belts 15 remain at rest while the arms 55 begin their movement towards the station 4. When the suckers 46 reach the level of the support surface for the preshaped pieces, suction is interrupted to release the pieces 2 from the suckers and the control of the vertical position of the preshaped piece 2 passes from the suckers 46 to the arms 55, which have almost reached their working position shown in FIG. 5.

At this point the shafts 65, 57 and 59 have made one complete revolution, and the described operating cycle is repeated at a rate of approximately 7 cycles per second.

From the preceding description it is apparent that the mobile arms 55 make it possible not only to load the preshaped pieces 2 on to the conveyor 1 from above, but also to drive this latter stepwise at a relatively high frequency of forward movement.

In this respect, the arms 55, reducible at a front mobile portion of the guide knife 38, enable the vertical position of the preshaped pieces 2 to be kept under control even during their first feed step. This first step is very critical for the preshaped pieces 2 because, due to the speed with which they are left on the conveyor 1, they may rebound slightly and consequently the absence of a vertical guide at the inlet station 4 would automatically lead to a considerable reduction in the operating frequency of the conveyor 1.

The mobile arms 55 could evidently be of a different structure and different kinematic behaviour than those described, the only necessary condition for their correct use being their capacity to remain above the inlet station 4 during forward movement of the belts 15, and to move outside said path of descent for the preshaped pieces 2 on to the conveyor 1 so as not to interfere with these pieces when they are conveyed downwards by the suckers 46.

What I claim is:

1. A conveyor for feeding portions of sheet material, particularly preshaped or punched pieces of cigarette packet cardboard or the like, the conveyor being of the type having an inlet station and an outlet station for said preshaped pieces, a support and slide surface for said preshaped pieces extending between said inlet station and said outlet station, a plurality of transverse elements defining a plurality of conveying compartments for said preshaped pieces, means for feeding said conveying compartments stepwise towards said outlet station, elongate horizontally extending guide means disposed downstream of said inlet station and spaced above the support and slide surface to hold down and control the vertical position of the preshaped pieces inside the relative compartments along at least a part of their feed path, a magazine for such preshaped pieces and disposed above said inlet station of the conveyor, the magazine having an open bottom from which the preshaped pieces may be extracted, and pneumatic extractor means including a sucker beneath the magazine and movable vertically at said inlet station to extract said preshaped pieces one at a time from the bottom of said magazine and deposit them on said support and slide surface and into a respective conveying compartment disposed at said inlet station, and also including at least one guide element swingably mounted on a horizontal axis at said inlet station and swinging vertically to and from a working position in which the guide element is in superposed relation to the sucker and the preshaped piece carried downwardly by the sucker, such that the guide element holds the preshaped piece down on the support and slide surface and in said compartments and also in which working position the guide element is disposed in the path of downward travel of the preshaped pieces between the open bottom of the magazine and such compartments under influence of said extractor means, and operating means connected in coordinated relation to said stepwise feed means and arranged to move said swinging guide element away from said working position as said extractor means descend towards said inlet station, and to return the guide element to said working position on termination of the descent.

2. A conveyor as claimed in claim 1, wherein said swingable guide element comprises at least one substantially U-shaped arm mounted to swing in a vertical plane and about the horizontal axis extending perpendicular to the feed direction of said conveying compartments and said axis being disposed below the conveyor at said inlet station; said swinging arm being disposed with its concavity facing an axial end of said support and slide surface and the end of the arm extending horizontally and above said conveyor at the inlet station when disposed in said working position.

3. A conveyor as claimed in claim 1, wherein said operating means comprise a plurality of cams rotatable about respective axes, at least one first element swinging about a horizontal axis and cooperating with one of said cams to impart a vertical to-and-fro movement to said extractor means, and at least one second swinging element cooperating with another of said cams to impart a reciprocating rotation to said swinging guide element; said cams being configured and connected together in such a manner that a movement of said guide element from said working position corresponds substantially to an upward movement of said extractor means, while a movement of said guide element towards said working position corresponds substantially to a downward movement of said extractor means.

4. A conveyor as claimed in claim 3, further comprising control means operable together with said cams and arranged to interrupt the connection between said suction duct and said pneumatic suction unit when said sucker passes below said support and slide surface.

* * * * *